United States Patent [19]

Iafrate

[11] Patent Number: 4,839,035

[45] Date of Patent: Jun. 13, 1989

[54] CYLINDRICAL SCREEN SEPARATOR WITH SPIRALLY ARRANGED CLEARING AND CONVEYING BLADES

[76] Inventor: John A. Iafrate, 1471 Grandville Ave., Pontiac, Mich. 48055

[21] Appl. No.: 160,207

[22] Filed: Feb. 25, 1988

[51] Int. Cl.[4] ..... B07B 1/20

[52] U.S. Cl. ..... 209/300; 209/296; 209/389; 209/675

[58] Field of Search ..... 209/234, 245, 284, 296, 209/298, 299, 294, 660, 669, 672, 262, 288, 675, 293, 300, 379, 389

[56] References Cited

U.S. PATENT DOCUMENTS

| | | | |
|---|---|---|---|
| 146,993 | 2/1874 | Drury | 209/284 X |
| 1,420,685 | 6/1922 | Burch | 209/393 |
| 2,669,268 | 8/1950 | Meyer | 209/393 |
| 2,721,035 | 10/1955 | Lankford et al. | 209/284 |
| 4,190,526 | 2/1980 | Bachand | 209/245 |

FOREIGN PATENT DOCUMENTS

| | | | |
|---|---|---|---|
| 804617 | 4/1951 | Fed. Rep. of Germany | 209/296 |
| 380368 | 8/1973 | U.S.S.R. | 209/379 |

*Primary Examiner*—Johnny D. Cherry
*Assistant Examiner*—Gary C. Hoge
*Attorney, Agent, or Firm*—Gifford, Groh, Sheridan, Sprinkle and Dolgorukov

[57] ABSTRACT

A separator for separating different sized components from a material and which is particularly useful for separating rocks, branches and other debris from soil to form topsoil. The separator has a cylindrical screen formed from a plurality of circular bars which are spaced apart from each other by a predetermined distance. A shaft is coaxially rotatably mounted to the screen and includes a plurality of blades extending radially outwardly from it. Material having components of different sizes is fed into one end of the screen and the shaft is rotatably driven. In doing so, the blades crush the material, force the smaller components of the material through the space between adjacent bars, and simultaneously transport the material, together with its larger components, toward the other end of the screen.

11 Claims, 3 Drawing Sheets

CYLINDRICAL SCREEN SEPARATOR WITH SPIRALLY ARRANGED CLEARING AND CONVEYING BLADES

BACKGROUND OF THE INVENTION

I. Field of the Invention

The present invention relates to separators for separating different size solid components from a non-homogenous solid material.

II. Description of the Prior Art

Topsoil is formed by separating relatively large components from the smaller components of soil. These larger components in the soil include rocks, branches and other debris. The separation of topsoil from soil on a large scale or commercial scale has been previously accomplished by using vibrating screens. Such vibrating screens, however, have not proven wholly satisfactory in use.

One disadvantage of these previously known vibrating screens is that they are expensive both to manufacture as well as to operate. Consequently, this increases the overall cost of producing the topsoil.

A still further disadvantage of these previously known vibrating screens is that the topsoil separation is relatively slow. This also increases the overall cost to produce the topsoil.

SUMMARY OF THE PRESENT INVENTION

The present invention provides a separator which overcomes all of the above-mentioned disadvantages of the previously known separators.

In brief, the separator according to the present invention comprises an elongated, cylindrical screen formed from a plurality of circular bars. These circular bars are spaced apart from each other by a preset distance.

A shaft is rotatably mounted to the screen so that the shaft and screen are coaxial. A plurality of blades are secured to the shaft so that the blades extend radially outwardly from the shaft. Preferably, the outer end of each blade extends through the space between adjacent bars on the screen.

The material or soil containing different size components is fed into one end of the screen and the shaft is then rotatably driven. Rotation of the shaft simultaneously crushes the material, forces the smaller components of the material through the space between adjacent bars in the screen and transports the larger components of the material toward the other end of the screen. The other end of the screen is open and the larger components of the material, such as rocks, branches and the like are expelled through the other end of the screen and are discarded.

The smaller components of the material, i.e. the topsoil, passes radially through the screen openings and falls below the screen. A belt conveyor beneath the screen removes the topsoil and conveys it to any suitable collection point.

In the preferred embodiment of the invention, a hopper having an open top feeds the raw material to be separated to a conveyor which, in turn, conveys the material to the first end of the screen. A planar sieve has one side pivotally attached to the hopper so that the sieve overlies the top of the hopper and so that the sieve is movable between an upper and a lower position. A spring urges the sieve towards its upper position.

In use, the raw soil is dumped on the sieve by a tractor and the tractor is used to move the sieve to its lower position which compresses the spring. Upon release of the sieve by the tractor, the spring returns the sieve to its upper position which simultaneously ejects large stones and other rubbish and prevents the large stones and rubbish from entering the hopper and possibly jamming the screen.

BRIEF DESCRIPTION OF THE DRAWING

A better understanding of the present invention will be had upon reference to the following detailed description of the invention, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
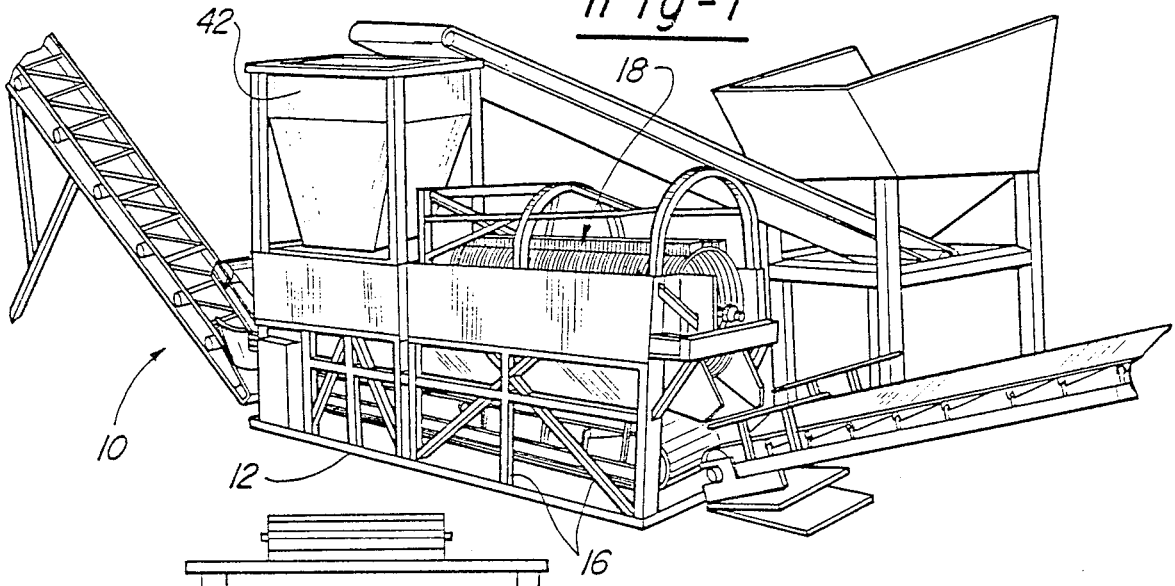
FIG. 1 is a perspective view of a preferred embodiment of the invention.
Figure 2:
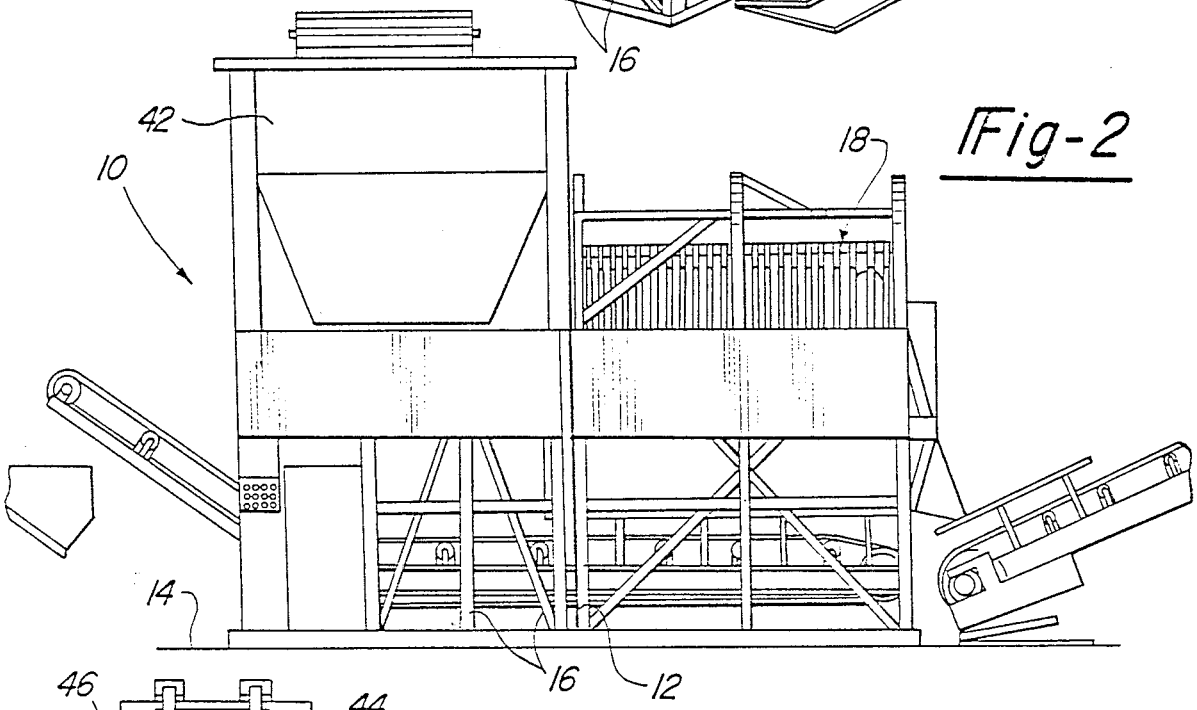
FIG. 2 is a side view of the preferred embodiment of the invention.

With reference first to FIGS. 1 and 2, a preferred embodiment of the separator 10 of the present invention is there shown and comprises a frame 12 supported on a ground surface 14. Any conventional means, such as metal framing members 16, can be used to construct the frame.

Figure 3:
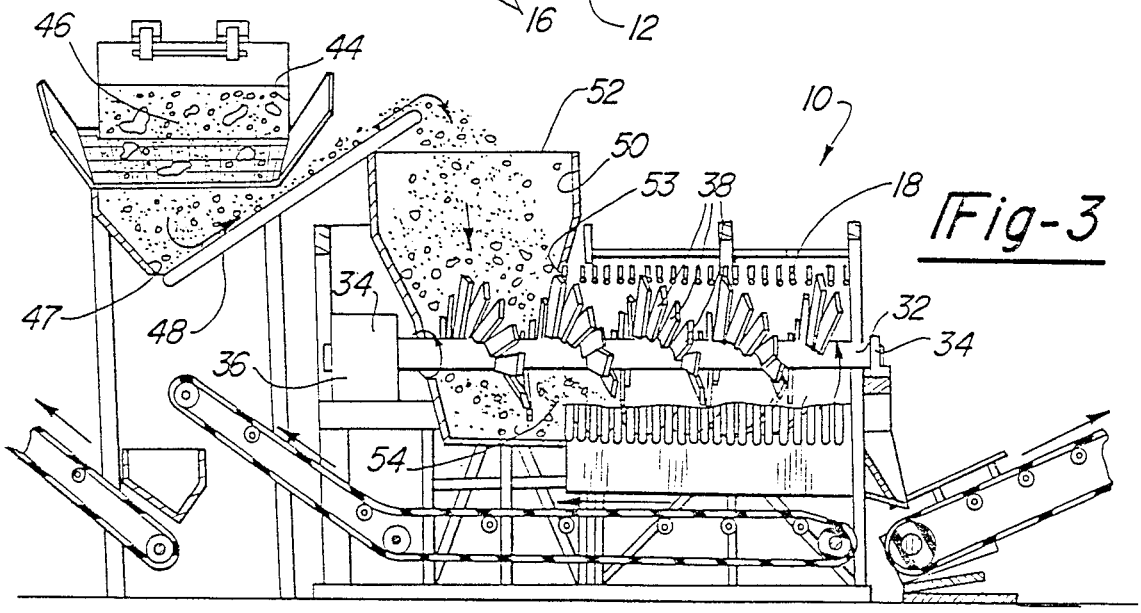
FIGS. 3 and 3A are partial sectional side views of the preferred embodiment of the invention.
Figure 6:
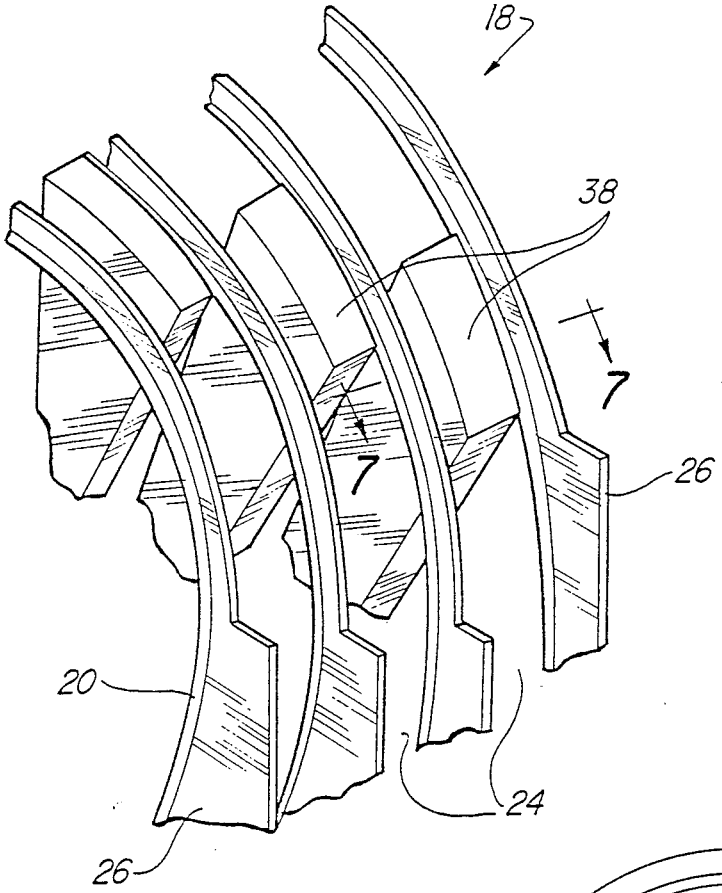
FIG. 6 is a fragmentary view of a portion of the preferred embodiment of the invention.
Figure 7:
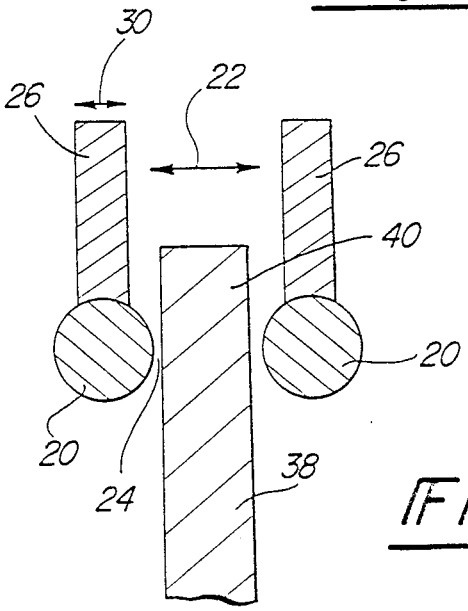
FIG. 7 is a sectional view taken along line 7—7 in FIG. 6 and enlarged for clarity.

An elongated cylindrical screen 18 is mounted to the frame 12 so that the axis of the screen 18 extends generally horizontally. As is best shown in FIGS. 3, 6 and 7, the screen 18 is formed from a plurality of bars 20 which are circular in shape and preferably circular in cross-sectional shape. The bars 20 are spaced apart and parallel to each other and are separated from each other by a preset distance 22 so that a space 24 is provided between each pair of adjacent bars 20.

As best shown in FIGS. 6 and 7, a generally flat reinforcing member 26 is secured to each bar 20 so that the reinforcing member 26 extends radially outwardly from its associated bar 20. As best shown in FIG. 7, the thickness 30 of the reinforcing member 26 is less than the diameter of the bar 20 for a reason to be subsequently described.

Figure 3A:
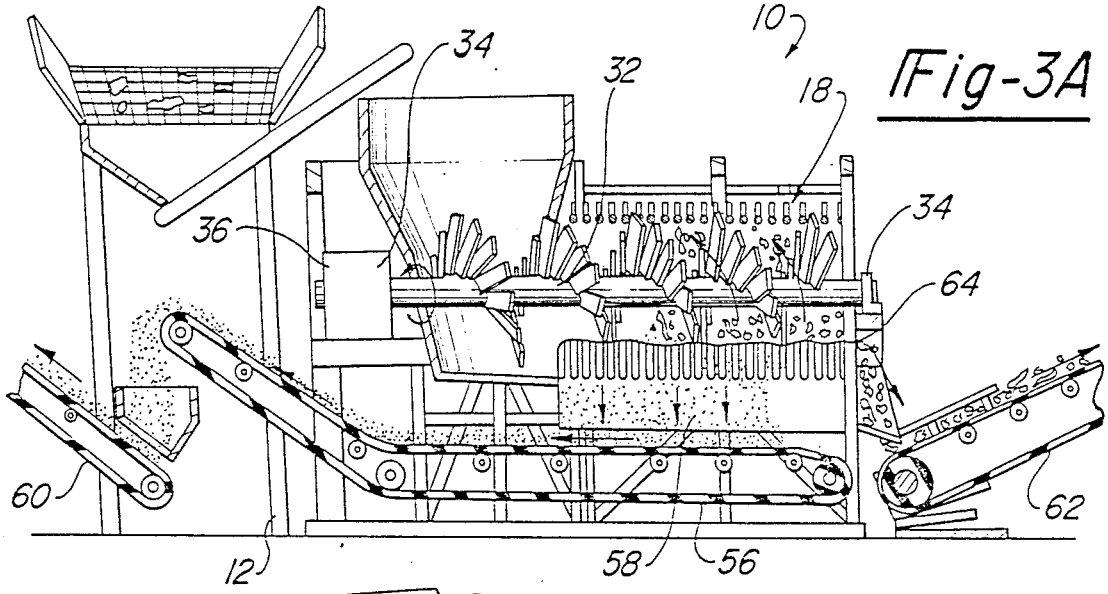

With reference now to FIGS. 3 and 3A, a shaft 32 is rotatably mounted to the frame 12 by conventional means 34 so that the shaft 32 extends coaxially through the screen 18. A motor 36 is mechanically connected to the shaft 32 and, upon activation, rotatably drives the shaft 32.

Figure 8:
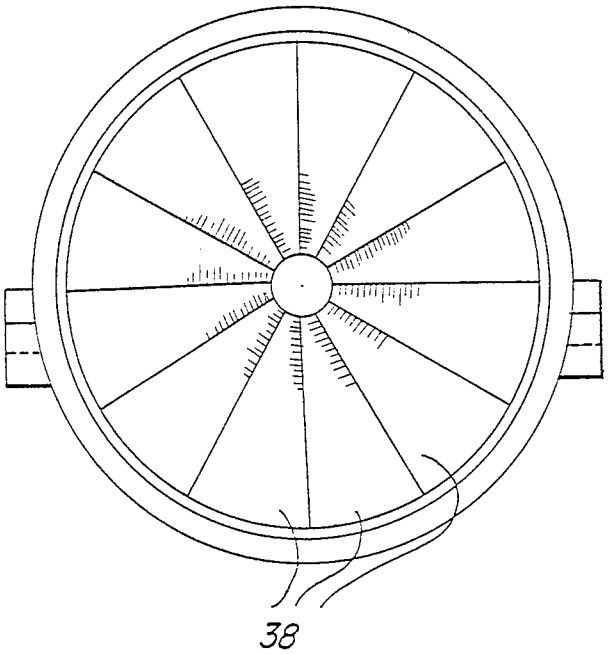
FIG. 8 is a fragmentary end view of a portion of the preferred embodiment of the invention.

With reference now to FIGS. 3, 6 and 8, a plurality of blades 38 are secured to and extend radially outwardly from the shaft 32. Adjacent blades 38 are circumferentially adjacent each other but are axially spaced from each other by an axial distance equal to the distance 24 between adjacent bars 20. Thus, the blades 38 together with the shaft 32 approximate a screw or an auger as best shown in FIGS. 3 and 3A. Furthermore, as best shown in FIG. 7, the blades 38 are dimensioned so that an outer end 40 of each blade 38 extends through the space 24 between adjacent bars 20 for a reason to be subsequently described.

With reference now to FIG. 3, a first hopper 42 having an open top 44 is provided to receive the raw material 46 to be separated. The bottom 47 (FIG. 3) of the hopper 42 is open to an endless belt conveyor 48 which conveys the material 46 to the open top 50 of a second hopper 52. The bottom 53 of the second hopper 52 is open to one end 54 of the screen 18.

Referring now to FIG. 3A, an endless belt conveyor 56 is supported by the frame 12 beneath the screen 18. The conveyor 56 transports separated material 58 passing through the screen 18 to a further conveyor 60 which, in turn, transports the separated material 58 to a collection area (not shown).

Similarly, a conveyor 62 receives the "rubbish" from the open other end 64 of the screen 18 and transports this rubbish to another collection area (not shown) for disposal. As will become shortly apparent, when the separator is used to produce topsoil, this rubbish typically comprises branches, rocks and other large material.

Figure 4:
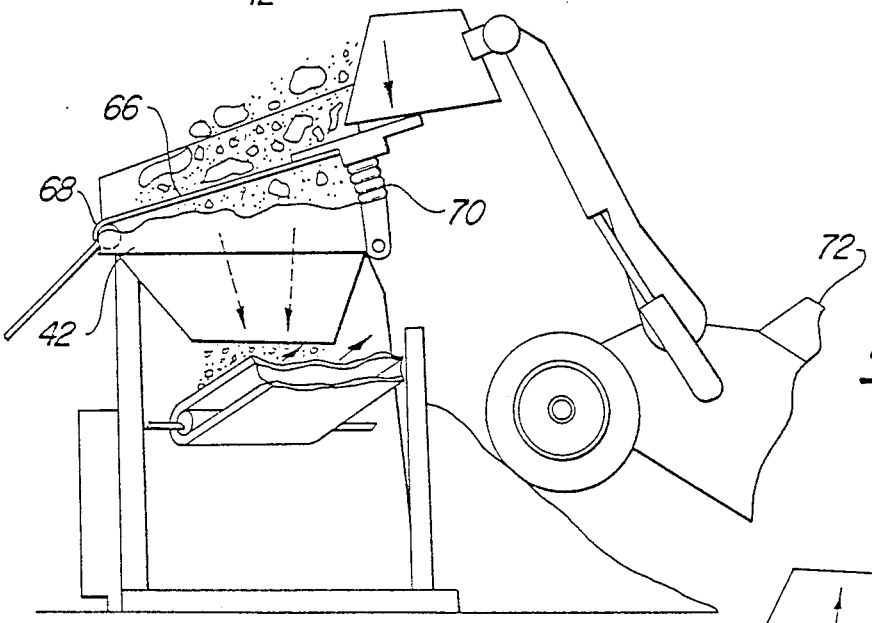
FIGS. 4 and 5 are diagrammatic views of a portion of the preferred embodiment of the invention.
Figure 5:
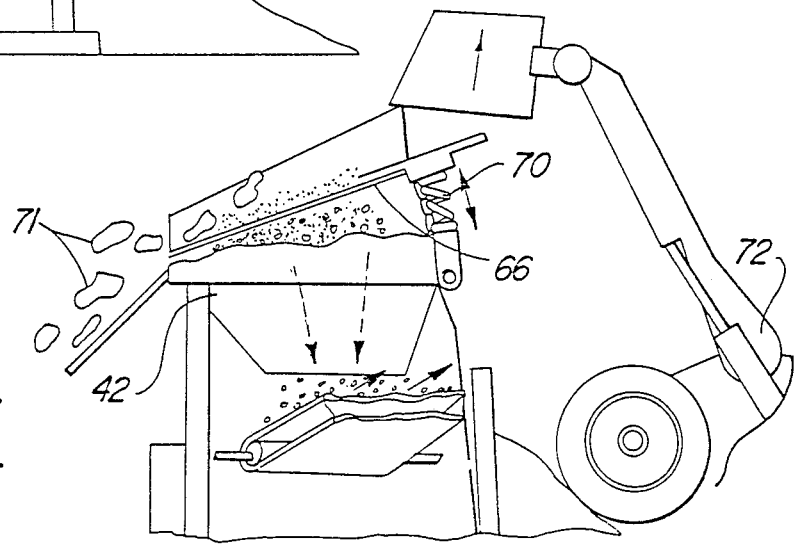

With reference now to FIGS. 4 and 5, in the preferred embodiment of the invention a generally planar sieve 66 has one side 68 pivotally mounted to one side of the first hopper 42 so that the sieve 66 overlies the top 44 of the hopper 42. The sieve 66 has relatively wide openings and is movable between an upper position, illustrated in FIG. 5, and a lower position, illustrated in FIG. 4. A spring 70 urges the sieve towards its upper position.

Still referring to FIGS. 4 and 5, a tractor 72 or the like is used to dump the raw material 46 on top of the sieve 66 and then compress the spring 70 thus moving the sieve 66 to its lower position (FIG. 4). Upon release of the sieve 66 by the tractor 72, the spring 70 returns the sieve to its upper position and simultaneously ejects large objects 71 from the top of the sieve 66.

In operation, the material to be separated, for example crude soil, is dumped by the tractor 72 on the sieve 66 and the tractor 72 is used to move the sieve to its lower position against the force of the spring 70. As previously described, upon release of the sieve 66 by the tractor 72, the sieve 66 ejects large objects, i.e. large stones and the like, from the top of the sieve 66.

The raw material 46, less the large objects, passes through the first hopper 42 to the conveyor 48 which transports the crude material 46 to the second hopper 52 and thus to the first end 54 of the screen 18. The use of the two hoppers 42 and 52 together with the conveyor 48 minimizes the chance of a jam in the inlet to the screen 18.

Rotation of the shaft 32 together with its attached blades 38 performs a number of simultaneous functions. First, the blades transport the material towards the other end 64 of the screen 18.

Secondly, the blades 38 separate and agitate the raw material 46 so that the smaller components of the material, i.e. the topsoil, pass radially through the screen 18 and onto the conveyor 56.

Thirdly, the blades 38 crush the raw material 46 thereby reducing larger components to smaller components.

The separated components or topsoil pass radially through the screen 18 and onto the conveyor 56. The larger components of the raw material 46 are ejected as rubbish from the other or open end 64 of the screen 18.

Since the blades 38 extend through the space between adjacent bars 20, the blades 38 prevent substantially all jamming of the screen 18. Since the thickness of the reinforcing members 26 are less than the diameter of the bars 20, the likelihood of jamming is further reduced since separated material which passes through the space 24 between the bars 20 will pass freely between adjacent reinforcing members 26.

Having described my invention, many modifications thereto will become apparent to those skilled in the art to which it pertains without deviation from the spirit of the invention as defined by the scope of the appended claims.

I claim:

1. A separator for treating material having two or more different components with different sizes, said separator comprising:

a generally cylindrical screen, said screen comprising a plurality of stationary circular bars, said circular bars being spaced apart and generally parallel to each other about an axis of said screen, a shaft rotatably mounted to said screen so that said shaft extends coaxially through said screen, a plurality of blades secured to and extending radially outwardly from said shaft, means for feeding a material into one end of said screen, means for rotatably driving said shaft so that said material is transported by said blades from said one end of said screen and toward the other end of said screen, an opening at said other end of said screen, wherein components of the material less in size than the spacing between said bars pass radially through said screen which the remaining components are transported to said opening, wherein an outer end of at least one blade extends through the space between two adjacent bars.

2. The invention as defined in claim 1 wherein an outer end of each blade extends through the space between two adjacent bars.

3. The invention as defined in claim 1 wherein said bars are circular in crossectional shape.

4. The invention as defined in claim 3 and comprising a reinforcing member attached to each bar, said reinforcing member having a thickness less than the diameter of said bar.

5. The invention as defined in claim 1 wherein said feeding means comprises:

a hopper having an open top and an open bottom, and means for conveying material from said bottom of said hopper to said first end of said screen.

6. The invention as defined in claim 5 wherein said conveying means comprises a belt conveyor.

7. The invention as defined in claim 5 and comprising:

a generally planar sieve, means for pivotally mounting one side of the sieve to one side of the top of said hopper so that said sieve overlies the open top of the hopper and so that said sieve is pivotal between an upper position and a lower position, means for resiliently urging said sieve towards said upper position.

8. The invention as defined in claim 1 and comprising means positioned beneath said screen for conveying components of the material which pass through said screen.

9. The invention as defined in claim 8 wherein said conveying means comprises a belt conveyor.

10. The invention as defined in claim 1 wherein said other end of said screen is open.

11. A separator for treating material having two or more different components with different sizes, said separator comprising:

a generally cylindrical screen, said screen comprising a plurality of circular bars, said circular bars being spaced apart and generally parallel to each other about an axis of said screen, a shaft rotatably mounted to said screen so that said shaft extends coaxially through said screen, a plurality of blades secured to and extending radially outwardly from said shaft, means for feeding a material into one end of said screen, means for rotatably driving said shaft so that said material is transported by said blades from said one end of said screen and toward the other end of said screen, an opening at said other end of said screen, wherein components of the material less in size than the spacing between said bars pass radially through said screen which the remaining components are transported to said opening, wherein said bars are circular in cross-sectional shape, and a reinforcing member attached to each bar, said reinforcing member having a thickness less than the diameter of said bar.

* * * * *